US010518947B2

(12) United States Patent
Kasper et al.

(10) Patent No.: US 10,518,947 B2
(45) Date of Patent: Dec. 31, 2019

(54) CONTROLLED POUR BOTTLE

(71) Applicants: Joseph A. Kasper, Lexington, KY (US); Steven B. Ruble, Lexington, KY (US)

(72) Inventors: Joseph A. Kasper, Lexington, KY (US); Steven B. Ruble, Lexington, KY (US)

(73) Assignee: Valvoline Licensing & Intellectual Property LLC, Lexington, KY (US)

( * ) Notice: Subject to any disclaimer, the term of this patent is extended or adjusted under 35 U.S.C. 154(b) by 0 days.

(21) Appl. No.: 15/343,278

(22) Filed: Nov. 4, 2016

(65) Prior Publication Data

US 2018/0127170 A1 May 10, 2018

(51) Int. Cl.

| | |
|---|---|
| ***B65D 25/38*** | (2006.01) |
| ***B65D 47/32*** | (2006.01) |
| ***B65D 1/02*** | (2006.01) |
| ***B65D 47/12*** | (2006.01) |
| *B65D 25/28* | (2006.01) |

(52) U.S. Cl.

CPC ..... *B65D 47/32* (2013.01); *B65D 1/0207* (2013.01); *B65D 47/122* (2013.01); *B65D 25/2885* (2013.01)

(58) Field of Classification Search

CPC ..... B65D 1/20; B65D 1/0207; B65D 47/32; B65D 47/122; B65D 25/2885; B65D 2205/00; B65D 25/48; B65D 25/42; Y10S 215/902

USPC ..... 222/468, 479, 482; 215/902

See application file for complete search history.

(56) References Cited

U.S. PATENT DOCUMENTS 1,243,963 A * 10/1917 Moser ..... B65D 23/00 215/386
1,852,475 A * 4/1932 Olds ..... B65D 25/42 220/303
2,291,230 A * 7/1942 Johnson ..... B65D 25/48 220/86.1
2,300,440 A * 11/1942 Vaughn ..... B65D 47/061 222/488
2,373,118 A * 4/1945 Johnson ..... B65D 25/42 222/484
2,759,642 A * 8/1956 Rickard ..... B65D 25/48 222/479
3,746,200 A * 7/1973 Flider ..... B65D 21/0231 215/10
3,858,766 A * 1/1975 Schiemann ..... B65D 25/42 222/479
4,221,308 A * 9/1980 Goodall ..... B65D 25/44 222/478
4,928,861 A * 5/1990 Schiemann ..... B65D 1/20 222/189.07
5,000,335 A * 3/1991 Osborne ..... B65D 88/76 220/745
5,538,165 A * 7/1996 Frohn ..... B29C 49/4802 222/479

(Continued)

*Primary Examiner* — Charles Cheyney
(74) *Attorney, Agent, or Firm* — Francis Law Firm PLLC; James M. Francis

(57) ABSTRACT

A controlled pour bottle is disclosed which possesses a vent tube leading from the neck to an elevated shoulder. The vent tube inhibits the interruption of the flow of a poured fluid due to the ingestion of air back into the bottle by allowing the headspace to fill with air without ingesting air through the fluid flow as the bottle empties.

15 Claims, 4 Drawing Sheets

(56) References Cited

U.S. PATENT DOCUMENTS

| | | | | |
|---|---|---|---|---|
| 7,331,490 | B2 * | 2/2008 | Yamana | B65D 1/20 215/902 |
| 7,959,044 | B1 * | 6/2011 | Christian | B65D 1/20 215/902 |
| 2008/0210658 | A1 * | 9/2008 | Jo | B65D 23/04 215/379 |

* cited by examiner

Fig. 2
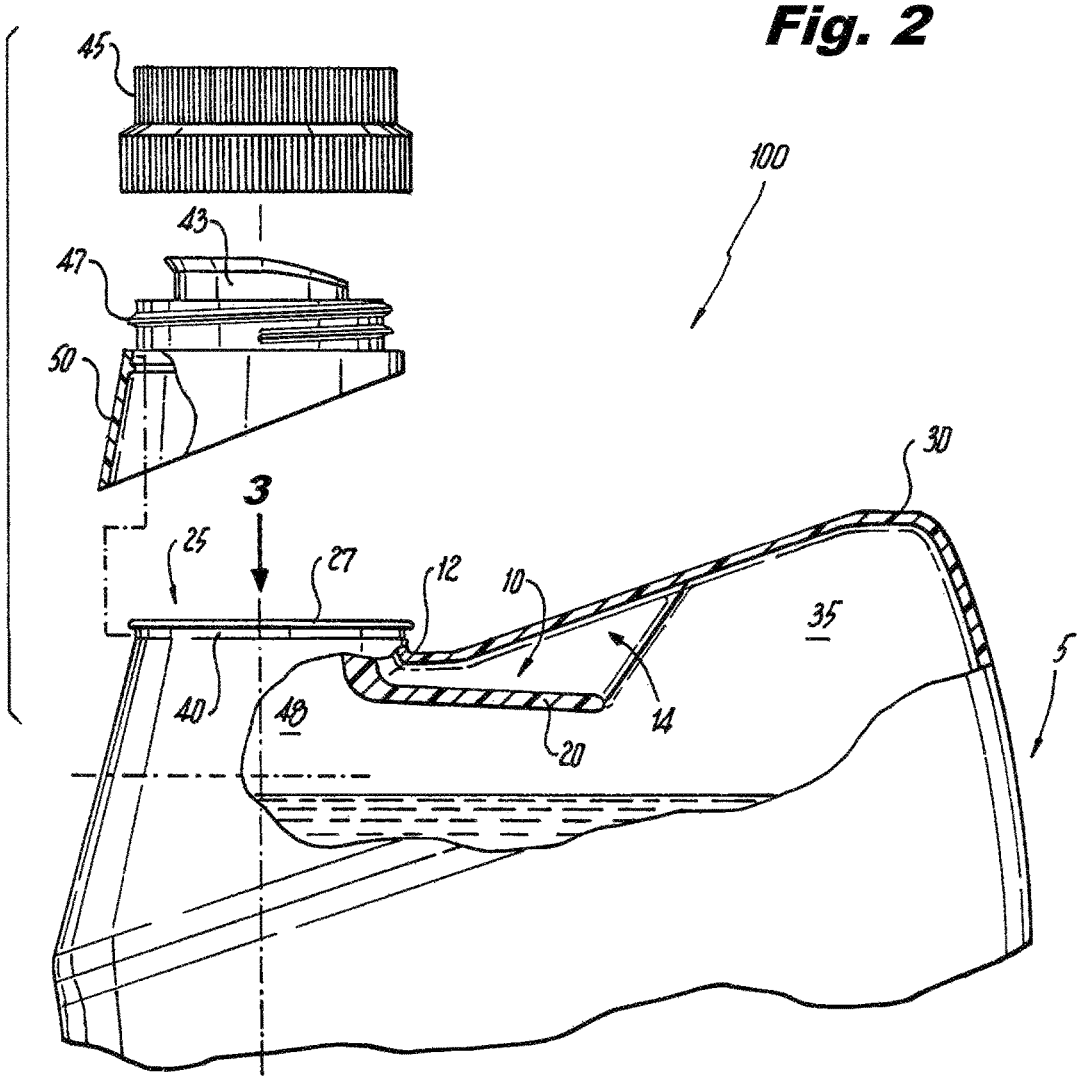
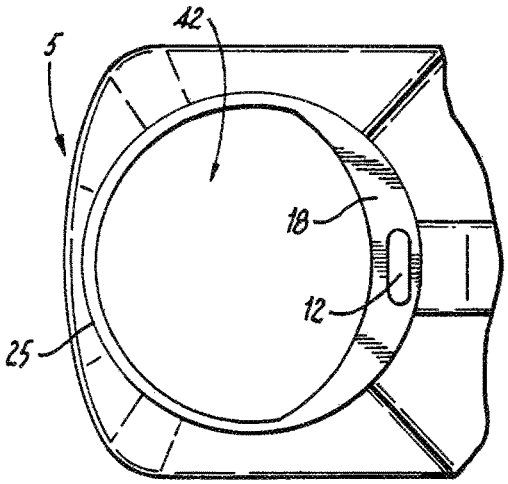
Fig. 3

CONTROLLED POUR BOTTLE

TECHNICAL FIELD

The apparatus of the present application relates generally flow control structures for bottles. More specifically, the apparatus of the present application relates to structures that reduce or eliminate the interruption of the flow of a liquid from a bottle due to the ingestion of air through the bottle mouth.

BACKGROUND

Many situations require the partial or total inversion of a bottle of liquid prior to pouring out the liquid contents. In many cases the contents are poured into a small opening, e.g. the addition of a lubricant to an engine crankcase through a relatively small opening without the use of a large funnel. Even when a funnel or pouring spout is used, lubricant often spills onto the engine or onto the ground which wastes product and creates a spill which must be remediated. Similar situations arise when adding brake fluid, transmission fluid, and coolant to fluid reservoirs.

Given the cost of many functional fluids and materials, especially synthetic lubricants, there is a high economic cost to the loss of product that when multiplied by the number of spills has a significant economic impact. The same is true for the environmental impact of spilled material that cannot be easily or cost effectively remediated. Moreover, the cost of labor in cleaning and remediating spills in the garage, at the worksite, and in the restaurant kitchen is also damaging due to lost economic opportunity.

The act of pouring a liquid from a bottle in a controlled manner to avoid spills is not without its challenges. As liquids are poured from an inverted bottle the pressure drops in the headspace of the bottle as the liquid leaves the bottle through the neck but is not replaced. The pressure differential between the headspace and the environment outside of the bottle eventually overcomes the force of gravity on the liquid pouring from the bottle and the flow is intermittently interrupted as air is drawn into the bottle to fill the headspace and equalize the pressure. The equilibrium across the system stays in flux and cycles between the increased pressure differential overcoming the force of gravity causing the pour and the decrease in the pressure differential resuming the flow.

Notably, several variables affect the rate of flow across the pour (e.g. viscosity, density, surface tension, etc.) and the end result is an ingestion of air across the top of the pour as an air channel is intermittently created. As air is added to the headspace, the pressure differential decreases but is in competition with the continuing increase of headspace causing the pressure differential to increase. The result is that the flow of liquid from an inverted bottle is turbulent because the ingestion of air back into the bottle is sporadic and results in a decrease in flow rate while air is ingested followed by increases in flow rate that manifest themselves as gushes of liquid. This turbulent flow results in the relative inability to control the flow of liquid from one point to another as it leaves the bottle's neck and results in spillage when trying to pour a liquid to a specific point.

SUMMARY

The present application discloses a controlled pour bottle having an arrangement of structures incorporated within the bottle that reduces or eliminates the interruption of the flow of a poured liquid due to the ingestion of air back into the bottle due the vacuum created in the head space as the bottle empties.

It is an object of this application to provide a bottle which minimizes the spillage of poured liquid by providing a more controlled pour.

It is a further object of this application to provide a controlled pour bottle with a vent that drains back into the bottle.

The present apparatus recognizes and addresses the previously-mentioned long-felt needs and provides utility in meeting those needs in its various possible embodiments. To one of skill in this art who has the benefits of this disclosure's teachings, other and further objects and advantages will be clear, as well as others inherent therein. The disclosures herein are not intended to limit the scope of the invention, merely to provide context with which to understand the patent claims.

BRIEF DESCRIPTION OF THE DRAWINGS

FIG. 2 depicts an exploded partial perspective view of the top of a controlled pour bottle.

FIG. 3 depicts a top down plan view of a cross section of the neck of a controlled pour bottle.

DETAILED DESCRIPTION OF THE PREFERRED EMBODIMENTS

Figure 1:
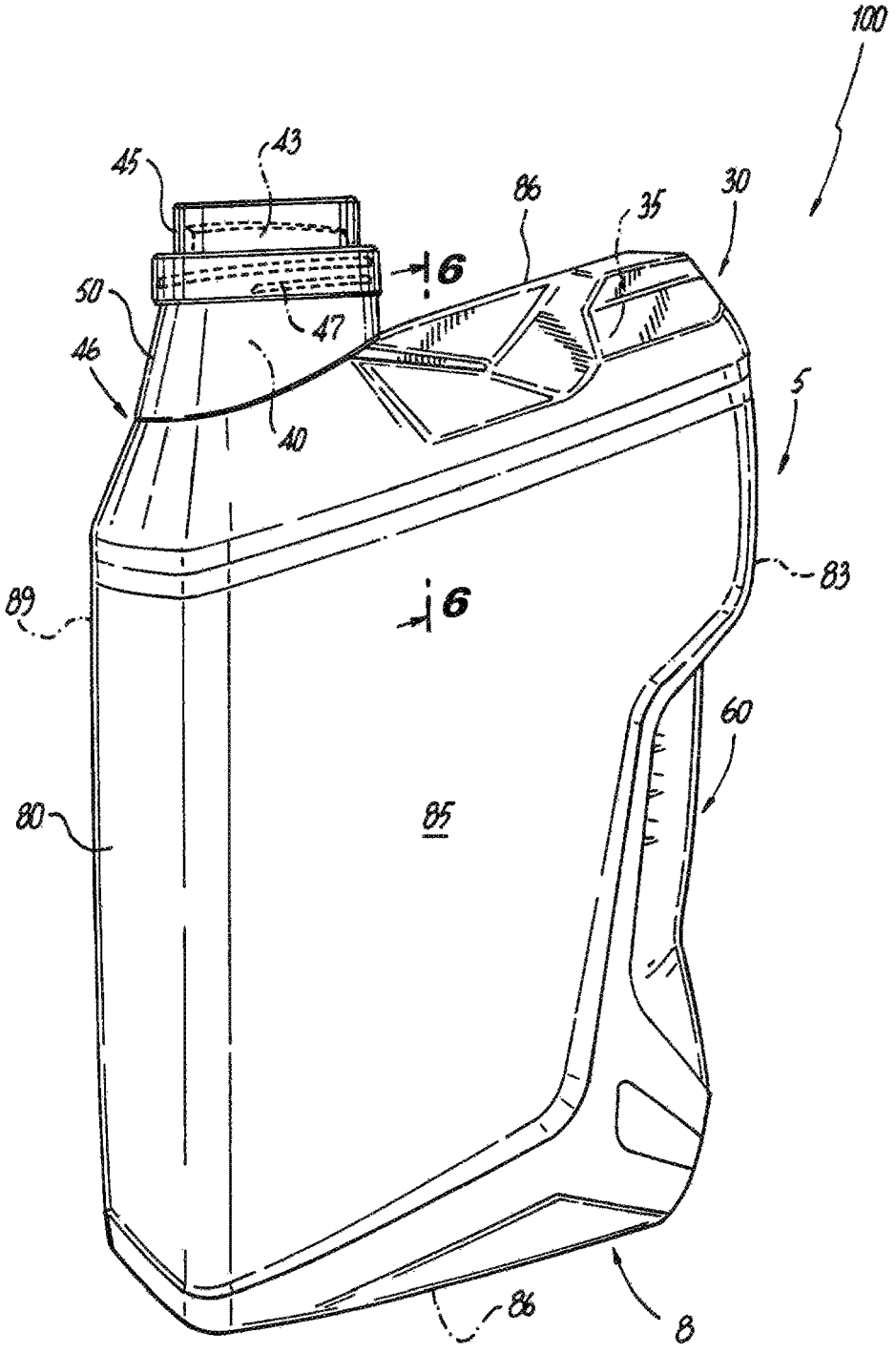
FIG. 1 depicts a side perspective view of an embodiment of a controlled pour bottle.
Figure 4:
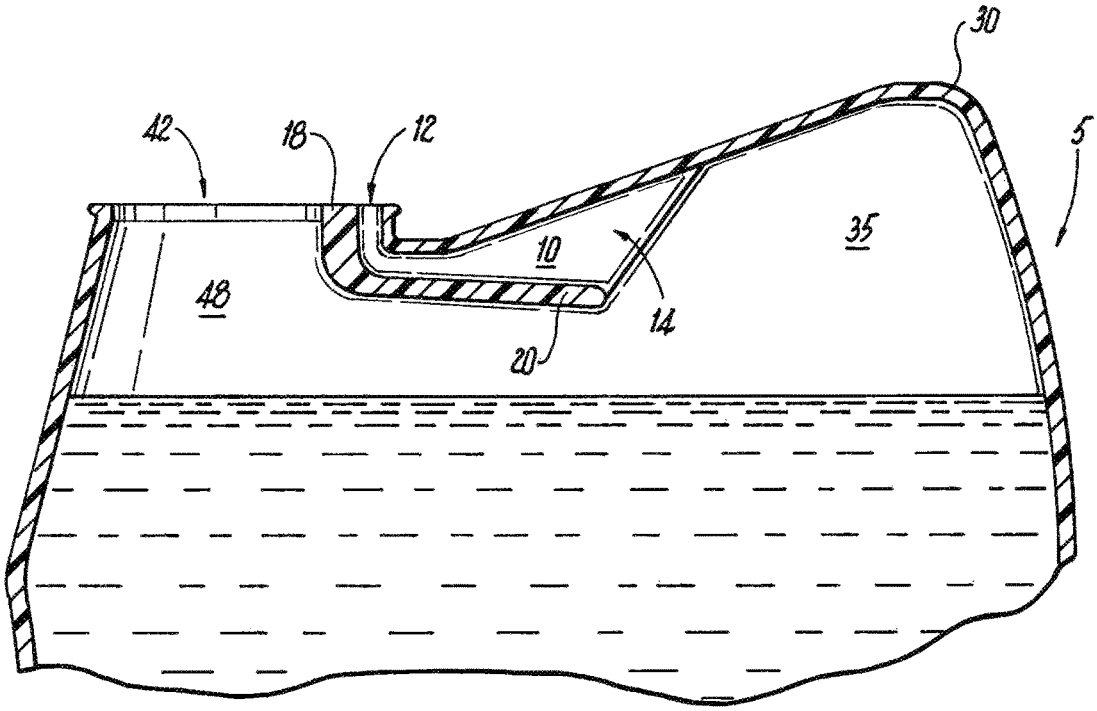
FIG. 4 is a partial cross section of the top of a controlled pour bottle.
Figure 5:
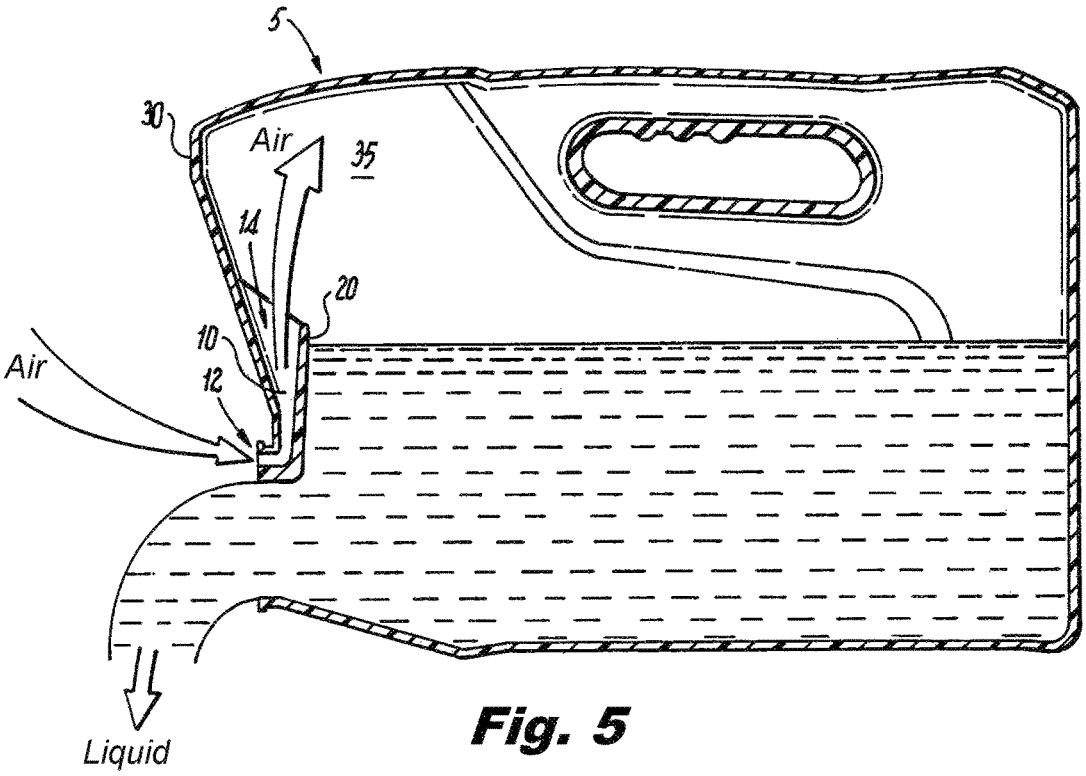
FIG. 5 depicts a cross section of a controlled pour bottle pouring a liquid contained therein.

The present application describes the various elements and embodiments of a controlled pour bottle 100 for dispensing liquids. A controlled pour bottle 100, as depicted in FIGS. 1 through 6, is disclosed herein as possessing a hollow bottle body 5 having a neck 40 from which the bottle 100 contents may be dispensed and a shoulder 30 projecting from the bottle body 5 to provide additional headspace 35 within the body 5 between the surface of a contained liquid and the top wall 86. The bottle ceiling rises to terminate at the shoulder at an inclination of at least 3°.

The bottle 100 preferably, but not necessarily, possesses a proximal wall 80, a distal wall 83, a first side wall 85, and a second side wall 89, a base wall 84, and a top wall 86. The proximal wall 80 extends vertically from the base wall 84 to the top wall 86 and terminates at the neck 40. The distal wall 83 extends vertically from the base wall 84 to the top wall 86 and terminates at the shoulder 30.

The neck 40 preferably projects vertically from the neck base 46 and is capped with a hollow neck sheath 50 which possesses a pour channel 52 along its vertical axis, threads 47 for securing a threaded cap 45, and a spout 43 to provide some control over the pour. The neck 40 and sheath 50 are joined at the neck lip 27 which runs along the perimeter of the neck top 25. The sheath 50 overlays and covers the neck 40 which terminates within the sheath 50. In an embodiment, the sheath 50 is secured to the neck 25 by snapping onto the neck 25 over the neck lip 27. In another embodiment, the sheath 50 is sonically welded to the neck 25.

The neck 45 possesses two orifices, a liquid flow orifice 42 and a neck vent orifice 12. Both the liquid flow orifice 42 and the neck vent orifice 12 are preferably sited at the neck top 25. The neck vent orifice 12 is sited against the wall of the neck 40 on the shoulder side of the neck 40 so that it will be positioned above the liquid flow orifice 42 during pouring. The liquid flow orifice 42 and the neck vent orifice 12 are separated within the neck 40 by an orifice dam 18 which is preferably created by a pinch line 20 during the bottle molding process. The liquid contents of the bottle 100 pass through the neck's 40 liquid flow channel 48 to reach the liquid flow orifice 42 during pouring. The neck vent orifice 12 is preferably substantially coplanar with the liquid flow orifice 42 and is in communication with a bottle vent tube 10 which provides a means to passively return air from the neck 40 to the headspace 35 within the hollow bottle body 5 at the shoulder vent orifice 14 during a pour. The plane in which the neck vent orifice 12 lies is preferably substantially perpendicular to the vertical axis of the bottle 5. The bottle vent tube 10 begins at the neck vent orifice 12 and initially descends down the neck 40 before turning approximately 90° toward the bottle shoulder 30 while declining at an angle of at least −1° from horizontal until terminating at the shoulder vent orifice 14. The bottle vent tube 10 terminates at a point in the shoulder 30 that lies below the neck vent orifice 12 when the bottle 100 is upright so as to cause the vent tube 10 to drain its liquid contents back into the neck 40. Preferably, the cross sectional area across the vent tube 10 is at no point less than the cross sectional area of the neck vent orifice 12 and ideally the cross sectional area across the vent tube 10 is substantially the same along its length. In a further preferred embodiment, the cross sectional area of the vent tube 10 increases as the vent tube 10 progresses from the neck 40 to the shoulder vent orifice 14. A larger cross sectional area along the vent tube 10 from the neck 40 to the shoulder 30 may be necessary to accommodate more viscous liquids.

Figure 6:
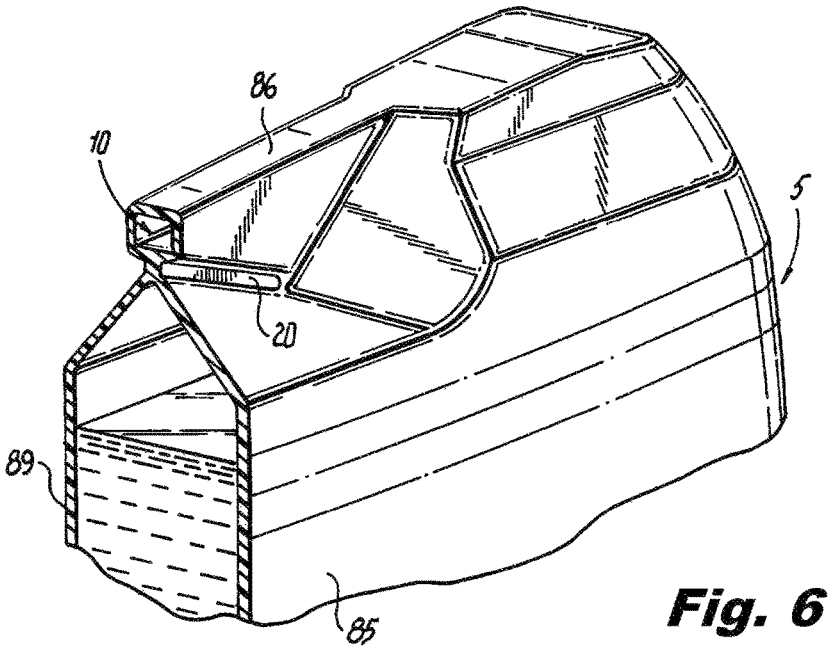
FIG. 6 depicts a partial cross section of the top of a controlled pour bottle.

In a commercially useful embodiment, the bottle 100 is constructed of molded plastic. As shown in FIG. 6, the neck vent tube 10 is formed above the pinch line 20 where the two molded halves of the bottle 5 are joined below the vent tube 10. The pinch line 20 extends distally from the neck 40 to the shoulder 30, forming a barrier between the vent tube 10 and the hollow bottle body 5 until the vent tube 10 terminates at the shoulder vent orifice 14, thus inhibiting the bottle's 100 liquid contents from entering the vent tube 10 at the shoulder 30 through the shoulder vent orifice 14. The shoulder vent orifice 14 at the distal end of the neck vent tube 10 needs to remain above the surface level of the liquid contained in the bottle 100 during the rotation of the bottle 100 during the pour. To inhibit the introduction of liquid into the neck vent tube 10 through the shoulder vent orifice 14 during a pour, the neck vent tube 10 terminates at the shoulder vent orifice 14 at a point at least 50% of the distance from the from the proximal wall 80 to the distal wall 83, and preferably at a point at least approximately 60% of the distance from the proximal wall 80 to the distal wall 83.

As the bottle 100 is inverted to pour out its contents, the neck 40 is rotated into a position that is lower than the shoulder 30. Ideally, the neck 40 and shoulder 30 will be positioned so that they both lie substantially within the same vertical plane, and the neck vent orifice 12 will be positioned above the fluid flow orifice 42 at the neck 40 when pouring out the bottle 100 contents so as to lie above the pour. As the liquid contents are poured from the bottle 100, the expanding headspace 35 in the shoulder causes air to be drawing into the shoulder 30 through the vent tube 10 and allows the rapid elimination of any pressure differential between the headspace 35 and the environment. The elimination of the pressure differential between the headspace 35 and the environment inhibits the ingestion of air into the bottle body 5 through the liquid flow orifice 42 thus creating a stable, predictable pour that reduces spillage. The placement of the neck vent orifice 12 above the liquid flow orifice 42 during the pour prevents the poured liquid from entering the bottle vent tube 10 and interfering with the air return function so as to induce turbulence into the flow of the pour. The negative slope of path of the bottle vent tube 10 from the neck 40 to the shoulder 30 prevents the liquid from accumulating within the bottle vent tube 10 by facilitating drainage of the bottle vent tube 10 back into the bottle body 5 through the shoulder vent orifice 14.

As the bottle 100 returns to its upright, resting position, any liquid that may have accumulated within the bottle vent tube 10 drains back into the bottle because of the negative slope of the vent tube 10.

In a preferred embodiment, the height of the cap 45 and the shoulder 30 are substantially the same so as to facilitate packaging and stacking. The bottle vent tube 10 and pinch line 20 act as a buttress to add structural stability to the elevated shoulder 30 to increase the shoulder's 30 load carrying capacity so as to prevent its collapse when stacking.

In a further preferred embodiment, the bottle 100 possesses a vertical handle 60, preferably ergonomically located beneath the shoulder 30 along the shoulder side of the bottle 100 and substantially midway between the shoulder 30 and the bottle base 8 so as to distribute mass directly above and below the handle 60.

What is claimed is:

1. A controlled pour bottle comprising a hollow bottle body; a proximal wall, a distal wall, a base wall, and a top wall; a neck extending vertically from said hollow bottle body, said neck originating at a neck base joined to said hollow bottle body and terminating at a neck top; a liquid flow channel housed within said neck connecting the interior of said hollow bottle body to a liquid flow orifice within said neck; an elevated bottle shoulder; a bottle vent tube having a length, a width, a height, a vent tube origin, and a vent tube end, said bottle vent tube originating within said neck at a neck vent orifice and having a roof which continuously ascends from a point at or adjacent to said neck to said vent tube end and a floor which descends from a point at or adjacent to said neck to said vent tube end.

2. The controlled pour bottle of claim 1, wherein said liquid flow orifice and said neck vent orifice have congruent angles relative to the walls of said neck.

3. The controlled pour bottle of claim 2, wherein said liquid flow orifice and said neck vent orifice are coplanar.

4. The controlled pour bottle of claim 3, wherein said liquid flow orifice and said neck vent orifice lie within a plane perpendicular to said neck's longitudinal axis.

5. The controlled pour bottle of claim 1, wherein a floor of said bottle vent tube descends at an angle of at least one degree or more from horizontal as it proceeds distally from said neck to said shoulder.

6. The controlled pour bottle of claim 5, wherein the cross-sectional area along the length of said bottle vent tube does not decrease from said neck vent orifice to said shoulder vent orifice.

7. The controlled pour bottle of claim 6, wherein the cross-sectional area across said bottle vent tube increases from the neck vent orifice to the shoulder vent orifice.

8. The controlled pour bottle of claim 5, wherein said ascending roof of said bottle vent tube rises at an angle of inclination of at least three degrees from horizontal from the neck to the shoulder.

9. The controlled pour bottle of claim 1, wherein said controlled pour bottle is constructed of molded plastic.

10. The controlled pour bottle of claim 9, wherein said neck vent tube terminates at a point at least half the distance from said proximal wall to said distal wall.

11. The controlled pour bottle of claim 10, wherein said neck vent tube terminates at a point at least sixty percent of the distance from said proximal wall to said distal wall.

12. The method of decreasing the turbulence in the flow of a liquid being poured from a bottle comprising venting said bottle through a bottle neck vent tube extending from a neck end to a shoulder end using a bottle vent tube which extends distally from a neck end of said bottle vent tube to said shoulder end of said bottle vent tube, said bottle vent tube having a roof which continuously ascends from said neck end of said bottle vent tube to said shoulder end of said bottle vent tube and a floor which continually descends from said neck end of said bottle vent tube end toward said shoulder end of said bottle vent tube, and said bottle vent tube possessing a substantially constant cross-sectional area across the length of said bottle vent tube.

13. The method of claim 12, further comprising elevating a bottle shoulder to increase the available headspace at a vent tube orifice within said shoulder.

14. The method of claim 13, further comprising terminating the roof of a bottle vent tube at a point within said shoulder above the origin of said bottle vent tube in said neck.

15. The method of facilitating the draining of a bottle vent tube when said bottle is returned to its upright, resting position by causing a vent tube floor to continuously descend distally from a neck end of a vent tube end to a shoulder end of said vent tube while causing a roof of said vent tube to continuously ascend distally from a neck end of said vent tube to a shoulder end of said vent tube.

* * * * *